United States Patent [19]

Hunt

[11] Patent Number: 5,072,467

[45] Date of Patent: Dec. 17, 1991

[54] BEACH TOWEL WITH POCKETS

[76] Inventor: Sean P. Hunt, 10501-1 Larwin Ave., Chatsworth, Calif. 91311

[21] Appl. No.: 710,460

[22] Filed: Jun. 5, 1991

[51] Int. Cl.[5] ..... A47G 9/06

[52] U.S. Cl. ..... 5/417; 5/419

[58] Field of Search ..... 5/417–420, 5/485; 190/2; D6/595, 596, 602, 603, 608

[56] References Cited

U.S. PATENT DOCUMENTS

| | | | |
|---|---|---|---|
| 3,226.737 | 1/1966 | Rote | 5/417 |
| 4,097,944 | 7/1978 | Yulish | 5/419 |
| 4,187,566 | 2/1980 | Peterson | 5/541 |
| 4,195,378 | 4/1980 | Parker | 5/419 |
| 4.375,111 | 3/1983 | Hall | 5/419 |
| 4,424,600 | 1/1984 | Callaway | 5/455 |
| 4,446,516 | 8/1984 | Sicoli et al. | 5/419 |
| 4,549,323 | 10/1985 | Brockhaus | 5/455 |
| 4,688,286 | 8/1987 | Miker, Sr. | 5/485 |
| 4,932,088 | 6/1990 | Domenning et al. | 5/451 |
| 4,972,534 | 4/1990 | Hutton | 5/451 |

*Primary Examiner*—Alexander Grosz

*Attorney, Agent, or Firm*—Allan M. Shapiro

[57] ABSTRACT

Beach towel has envelopes attached thereto so as to create closeable envelopes on the towel and pockets behind the envelope. The envelopes and/or pockets can be used for storing needed items such as sunscreen lotion, clothing items, or entertainment items such as a book or radio. The envelopes and/or pockets can alternatively be used as a receptacle for sand in order to hold down the beach towel and form a pillow.

17 Claims, 1 Drawing Sheet

BEACH TOWEL WITH POCKETS

FIELD OF THE INVENTION

This invention is directed to a beach towel which has pockets thereon to enhance the utility of the beach towel.

BACKGROUND OF THE INVENTION

When people go to the beach, they often carry beach towels with them. Despite the name "towel," many beach towels are not used for toweling, but are used as a mat to lie on the sand. When positioned, the person sits or lies on the beach towel, and the towel substantially protects him against the sand. One of the problems is that, when a towel lies on the sand in that manner, the wind tends to lift it and fold it or blow it away. Another problem is that such a beach towel closely follows the contour of the sand and does not provide a head rest. In addition, prior beach towels did not provide pockets which can be used for the storage of various items. Accordingly, there is need for a beach towel which provides storage space and which provides pockets which can receive sand to weight the beach towel in place.

SUMMARY OF THE INVENTION

In order to aid in the understanding of this invention, it can be stated in essentially summary form that it is directed to a beach towel with pockets. The pockets receive sand and/or items brought to the beach to hold the beach towel down, to store the items, and one of the pockets is positioned to serve as a pillow or head rest.

It is thus an object and advantage of this invention to provide a beach towel with pockets whereby the beach towel is restrained against blowing by placing sand in the pockets.

It is a further object and advantage of this invention to provide a beach towel with pockets which serves to give head rest contour to the beach towel when filled with sand or items brought by the beach goer to the beach.

It is a further object and advantage of this invention to provide a beach towel which has envelopes attached thereto so that the envelopes can be employed to retain items brought to the beach by the beach goer, and pockets are formed under the envelopes so that sand can also be placed in the pockets to give the beach towel shape and/or hold it in place.

It is a further object and advantage of this invention to provide a beach towel with pockets which can be economically produced so that it can be used widely and which can be folded readily for storage and carrying to and from the beach.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figures 1, 2, 3:
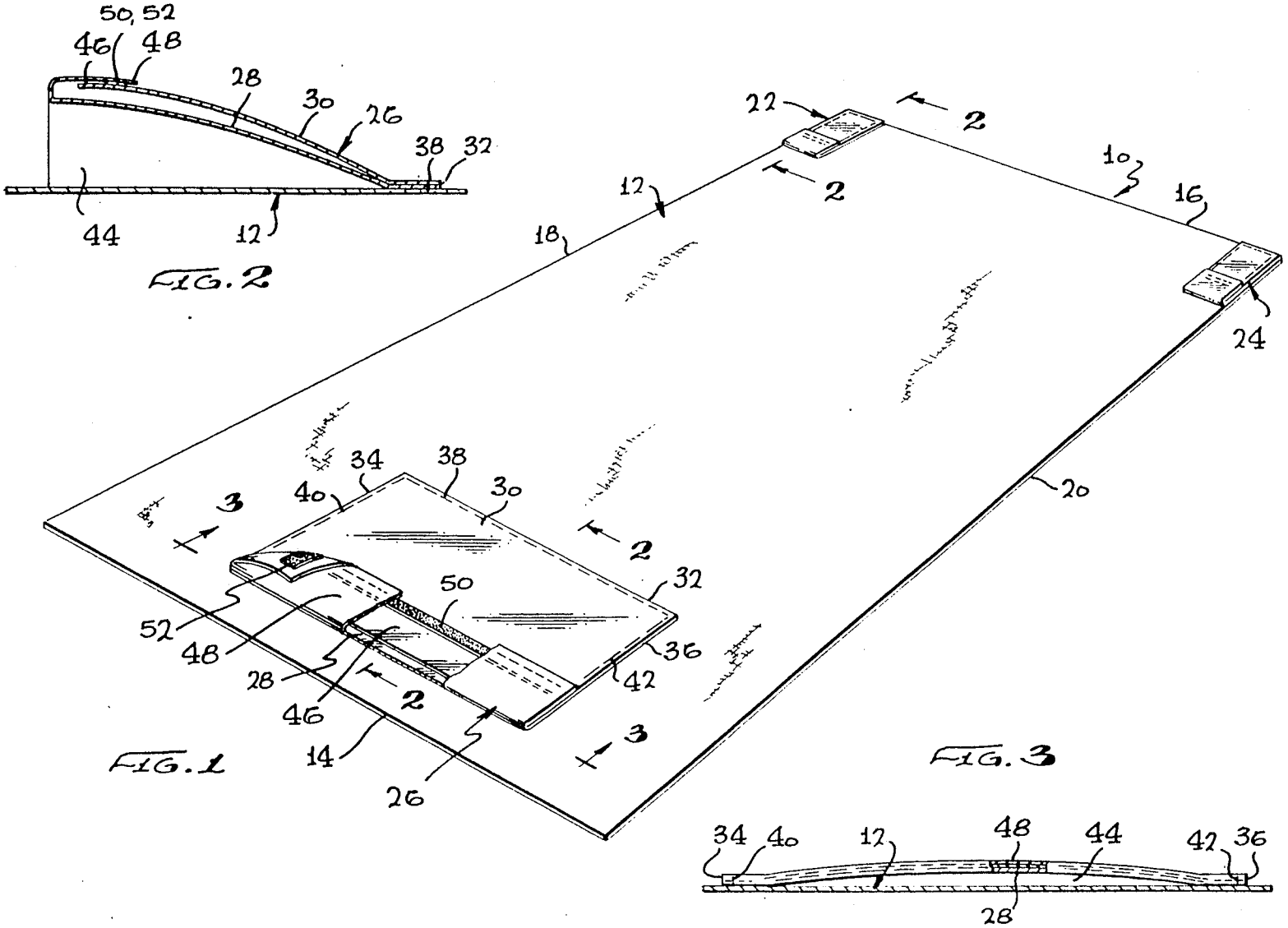
FIG. 1 is a perspective view of the beach towel with pockets in accordance with this invention.
FIG. 2 is an enlarged section taken generally along either of the lines 2—2 of FIG. 1, with parts broken away, which are the same except for size.
FIG. 3 is an enlarged section taken generally along 3—3 of FIG. 1, with parts broken away and parts taken in section.

The towel of this invention is generally indicated at 10 in FIG. 1. Its principal part comprises a sheet 12 made of toweling material. Sheet 12 is preferably of cotton terry cloth, similar to that of most ordinary beach towels. The sheet 12 has a top edge 14, a bottom edge 16, a left edge 18, and a right edge 20. These edges define the edges of the towel and are preferably in rectangular relationship to each other. The sheet 12 of the towel is approximately the same size as most common beach towels.

Fastened to the towel, all on the same side thereof, are three envelopes 22, 24 and 26. They are each of the same general configuration. The envelopes 22 and 24 are of the same size and of the same rectangular proportion. Envelope 26 is of the same structure, but is larger and longer in the cross-ways dimension than in the height dimension, as is seen in FIG. 1. Envelope 26 is shown in detail in FIGS. 1, 2 and 3. It is understood that the envelopes 22 and 24 are of the same structure, but of smaller size. Envelope 26 is formed with inner panel 28 and outer panel 30. These panels are co-extensive at the bottom panel edge 32, the left panel edge 34 and the right panel edge 36. The envelope 26 is secured to the towel sheet by stitching through both panels and the towel sheet adjacent these panel edges. The bottom seam line 38, the left seam line 40 and the right seam line 42 are seen in FIG. 1. The bottom seam line 38 is also seen in FIG. 2, while the left and right seam lines 40 and 42 are also seen in FIG. 3. The upper edges of the panels 28 and 30 are not sewn to the towel sheet to leave an open top pocket 44.

The outer panel 30 terminates in an upper edge 46, which is generally at the upper termination of the seam lines 40 and 42. The inner panel 28 is longer so that a flap 48 folds down over the upper edge and overlaps the upper portion of the outer panel 30, as seen in FIGS. 1 and 2. The flap 48 is long enough to fold over and overlie the top of the outer panel 30 in order to close the envelope. In order to releasibly close the flap and envelope, hook and loop fasteners 50 and 52 are provided, see FIG. 1.

There are a number of different ways in which the beach towel 10 can be used. The towel has both open-top pockets and closeable envelopes in three locations. In the lower corners, the envelopes 22 and 24 are sized to receive small items like cigarettes or sunburn lotion containers. The pockets behind the envelopes are sized to receive enough sand so that the lower corners of the towel are held down against blowing wind. In either the face-up condition shown or the face-down position, either the envelopes or the pocket in each lower corner or both can be filled with sand. In the face-up position, the pockets are more convenient for receipt, retention and storage of the beach goer's small items.

The upper envelope 26 is sized and positioned so as to serve as a head rest or pillow. It is spaced close to the top edge 14 of the towel sheet, and it is wider than it is tall in the general proportions of a rectangular pillow. Each of the evelopes is made of close-woven nylon fiber to be more resistant to sand passage than is ordinary terry cloth toweling. With this fabric, if sand is put in the upper envelope 26 or the pocket therebehind, the fabric resists transmission of the sand to the upper surface where the beach goer rests his head. When the towel 10 is oriented with the envelope 26 on top, as illustrated in FIG. 1, sand can be placed in the pocket and the beach goer's goods can be placed in the envelope. These goods may include a shirt, a small towel, the previously mentioned container of sunburn lotion, a pack of cigarettes, as well as entertainment devices such as playing cards, radio, audio tape player, magazines, or books. The fact that the fabric of the envelope is resistant to sand transmission protects the beach goer's supplies from the sand placed in the pocket behind the envelope. The envelope can contain sand alternatively to the beach goer's supplies, which again can be shaped to a suitable head rest. In this case, the envelope 26 can be positioned against the sand with the towel 10 inverted from the position shown in FIG. 1. In this way, a beach towel of wide utility is provided.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A beach towel comprising:

a towel sheet having first and second corners at a first end thereof;

at least first, second and third pockets formed on said towel sheet, each of said pockets having an inner and an outer panel, said inner and outer panels each being attached to said towel sheet along their bottom and sides edges to leave an open top edge to form said pocket, said inner panel being longer than said outer panel to fold back over said outer panel to form a flap which closes said pocket, said first and second pockets being positioned adjacent said first and second corners, said third pocket being positioned away from said first end, said third pocket being sufficiently large to form a head rest when filled with sand so that said towel sheet can be laid out on the beach sand and said first, second and third pockets can be filled with sand so that said first and second sand-filled pockets hold down said first and seconds corners of said towel sheet and said third pocket can serve as a head rest for a beach goer resting on said towel, at least said third pocket being formed of sand-transmission resistant fabric.

2. The beach towel of claim 1 wherein said towel is formed of terry cloth fabric which is formed principally of cotton and said third pocket is formed principally of tightly woven nylon fabric.

3. The beach towel of claim 1 wherein each of said three pockets is formed of tightly woven sand-transmission resistant fabric.

4. The beach towel of claim 3 wherein said pockets are formed of tightly woven nylon fabric.

5. The beach towel of claim 1 wherein said flap is detachably attached to said outer panel to close said pocket.

6. The beach towel of claim 5 wherein a hook and loop fastener is secured to said outer panel and to said flap to releasibly attach said flap to said outer panel.

7. The beach towel of claim 6 wherein said terry cloth towel sheet is formed principally of cotton and said third pocket is formed principally of tightly woven nylon fabric.

8. The beach towel of claim 6 wherein each of said three pockets is formed of tightly woven sand-transmission resistant fabric.

9. The beach towel of claim 8 wherein said pockets are formed of tightly woven nylon fabric.

10. A beach towel comprising:

a terry cloth towel sheet having a top edge and a bottom edge, said bottom edge having first and second corners, said towel sheet having a first surface;

first, second and third envelopes secured to said first surface of said towel sheet with said first and second envelopes secured adjacent said first and second corners and said third envelope secured adjacent said top edge, each of said envelopes having and inner and an outer panel and each of said envelopes having a bottom panel edge, a left panel edge and a right panel edge, said panel edges being substantially co-extensive, said panels being attached to said towel sheet adjacent said edges, said inner panel being longer than said outer panel along the unattached edge and forming a flap overlying said outer panel to close the space between said inner and outer panels to form an envelope, each said envelope being unattached to said towel sheet along one edge to form a respective pocket behind each said envelope so that said pockets behind said first and second envelopes can hold sand to hold down said first and second corners of said towel sheet and said pocket behind said third envelope can be filled with sand to form a head rest and said envelopes can carry beach goers' supplies, each said envelopes being made of sand-transmission resistant fabric.

11. The beach towel of claim 10 wherein said envelopes are formed of closely woven nylon fabric.

12. The beach towel of claim 11 wherein said towel sheet is formed of substantially cotton terry cloth.

13. The beach towel of claim 10 wherein said towel sheet is formed of substantially cotton terry cloth.

14. The beach towel of claim 10 wherein at least said third envelope has a detachable fastener to detachably secure said envelope flap to said outer panel.

15. The beach towel of claim 14 wherein said detachable fastener is a hook and loop fastener.

16. The beach towel of claim 10 wherein each of said first, second and third envelopes has a hook and loop fastener on its flap to detachably close said first, second and third envelopes.

17. The beach towel of claim 10 wherein each of said envelopes is attached to said towel sheet by a sewn seam along its bottom edge and its side edges to securely attach said envelopes to said towel sheet.

* * * * *